US007828389B2

(12) United States Patent
Oda

(10) Patent No.: US 7,828,389 B2
(45) Date of Patent: Nov. 9, 2010

(54) ARMREST DEVICE IN A CHAIR

(75) Inventor: Youichirou Oda, Yokohama (JP)

(73) Assignee: Okamura Corporation (JP)

( * ) Notice: Subject to any disclaimer, the term of this patent is extended or adjusted under 35 U.S.C. 154(b) by 191 days.

(21) Appl. No.: 11/939,869

(22) Filed: Nov. 14, 2007

(65) Prior Publication Data

US 2008/0191537 A1 Aug. 14, 2008

(30) Foreign Application Priority Data

Feb. 9, 2007 (JP) ..... 2007-030239
Feb. 9, 2007 (JP) ..... 2007-030240
Feb. 13, 2007 (JP) ..... 2007-032412
Feb. 13, 2007 (JP) ..... 2007-032413

(51) Int. Cl.
*B60N 2/46* (2006.01)

(52) U.S. Cl. ..... 297/411.36; 297/411.35

(58) Field of Classification Search ..... 297/411.36, 297/411.35, 411.378
See application file for complete search history.

(56) References Cited

U.S. PATENT DOCUMENTS 5,265,938 A * 11/1993 Melhuish et al. ..... 297/411.36
5,382,079 A * 1/1995 Wilson et al. ..... 297/411.36
5,439,267 A * 8/1995 Peterson et al. ..... 297/411.36
5,664,842 A * 9/1997 Tseng ..... 297/411.36
5,931,537 A * 8/1999 Gollin et al. ..... 297/411.36
6,139,107 A * 10/2000 Lee ..... 297/411.36
6,540,300 B2 * 4/2003 Piretti ..... 297/411.35
6,824,218 B1 * 11/2004 van Hekken ..... 297/411.36
2008/0296955 A1 * 12/2008 Geister et al. ..... 297/411.36

FOREIGN PATENT DOCUMENTS

JP 9-173178 7/1997
JP 2000-279268 10/2000
JP 2002-51871 2/2002
JP 2005-185619 7/2005
JP 2005-192766 7/2005
JP 2005-211245 8/2005

* cited by examiner

*Primary Examiner*—Sarah B McPartlin
(74) *Attorney, Agent, or Firm*—Ostrolenk Faber LLP

(57) ABSTRACT

An armrest device comprises an armrest base plate on the upper end of an armrest support rod. A support block is provided on the armrest base plate. An engagement portion of the support block engages in a slot of the armrest base plate. A plurality of grooves are formed on a projection along the slot. An elastic tongue of the support block engages with the projection to allow the armrest base plate to slide back and forth smoothly.

The armrest support rod is surrounded by an intermediate tube and an armrest support tube. A turning lever in the armrest support rod is pivotally mounted to an operating lever on the upper end of the armrest support rod. A pin which passes through a hole of the turning lever engages in an opening of the intermediate tube. The opening comprises a vertical elongate portion and a plurality of horizontal engagement portions. The pin selectively engages in any one of the engagement portions to allow the armrest to be held at respective height.

8 Claims, 15 Drawing Sheets

ARMREST DEVICE IN A CHAIR

BACKGROUND OF THE INVENTION

The present invention relates to an armrest device in a chair.

JP2005-211245A and JP2002-51871A disclose an armrest device in which an elongate hole is formed in an armrest base plate, a plurality of grooves being formed on each edge of the elongate hole, an elastic member being provided to press the side edge of the elongate hole on a support provided on the upper end of an armrest support rod for supporting an armrest to allow the armrest base plate to move with respect to the armrest support rod, the elastic member elastically engaging in the groove to provide stepwise resistant force of the armrest base plate. However, the grooves on the side edge of the elongate hole make movement of the armrest base plate unsmooth.

In JP2005-211245A, a pair of engagement pins is provided on each side of the elastic member and pressed onto the side edge of the elongate hole, so that the number of parts increases and assembling becomes more complicated.

In JP2002-51871A, the elastic member comprises a pair of bow-like members which are held by an armrest bracket. To keep rigidity and durability of the bow-like members, it is necessary to pay special attention to determine the material and shape thereof.

JP2005-192766A discloses an armrest device by which an armrest can be moved and turned. But the structure therefor makes the armrest device larger, and there are problems that the number of parts increases and its assembling becomes more complicated.

JP9-173178A, JP2000-279268A and JP2005-185619A disclose an armrest device in a chair, comprising a lower support rod extending upright from the side of a seat and an upper support rod having an armrest on the upper end to allow the upper support rod to slide with respect to the lower support rod up and down, an operating lever having an operating portion which projects from the side of the upper support rod, the operating lever being operated to move an engagement shaft or pin in the upper support rod being moved back and forth to allow the engagement shaft to engage in any one of multi-stage engagement portions extending from a vertical elongate portion in the lower support rod thereby holding the upper support rod at a desired height.

In JP9-173178A and JP2000-279268A, the operating portion and an extension for moving the engagement shaft back and forth are integrally formed like a reversed U-shape. The operating lever is pivotally mounted to the upper support rod with a pin at a curved portion of the U-shape. The distance between a pivot and an acting point is long. During operation, excessive force acts onto the operating portion, so that the pivot and/or extension is likely to be easily deformed or damaged. It is necessary to make the member from high-rigidity material.

In JP2005-185619A, an operating knob presses the upper end of an operating rod as pivoting lever rearwards. A pin at the lower end of the operating rod is pivoted back and forth about the middle to allow the pin to engage in and disengage from the engagement hole.

The rear end of the knob merely contacts the front face of the upper end of the operating rod, but the knob is surely connected to the operating rod. If the pin should be caught on one of the engagement holes to make the operating rod impossible to return, the knob will not be operative. Means for limiting back-and-forth movement of the knob becomes more complicated.

JP2005-185629A discloses an armrest device that enables the height of an armrest to be adjusted in a chair. In the device, an arm pad support rod for supporting an arm pad slidably fits up and down in a tubular armrest support rod which stands from the side of a seat. A knob at the upper part of the arm pad support rod is pressed to move the upper part of an operating rod pivotally mounted in the middle in the arm pad support rod to move a pin at the lower part of the operating rod forwards to allow the pin to disengage from any one of multi-stage engagement grooves at the side of a guide sleeve in the armrest support rod. After the armrest and armrest support rod are moved to a desired height, a hand is released from the knob, so that the pin is moved rearwards by force of urging means to engage in any one of the engagement grooves.

The guide sleeve comprises two semicylindrical pieces in which outward flanges contact the upper end of the armrest support rod.

However, the guide sleeve merely comprises two semicylindrical pieces which pressingly fit in the armrest support rod. When the armrest is elevated, the guide sleeve is likely to be released upwards from the armrest support rod.

To prevent such problem, the guide sleeve is fixed to the armrest support rod with screws, but heads of the screws are exposed to make its appearance poorer and working for mounting the screws is more complicated to make its assembly more difficult.

SUMMARY OF THE INVENTION

To overcome the disadvantages in the prior art, it is an object of the invention to provide an armrest device in a chair in which an armrest base plate can be moved stably and smoothly, the parts being reduced in number and assembled easily.

It is another object of the invention to provide an armrest device in a chair in which a turning mechanism and a back-and-forth moving mechanism are reduced in vertical size.

It is a further object of the invention to provide an armrest device in a chair in which the device is unlikely to be broken or deformed even if excessive force acts on an operating lever.

It is yet another object of the invention to provide an armrest height adjuster in a chair in which the parts are assembled without screws, an intermediate tube being prevented from being released after assembling.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

An embodiment of the present invention will be described with respect to the drawings.

Figure 1:
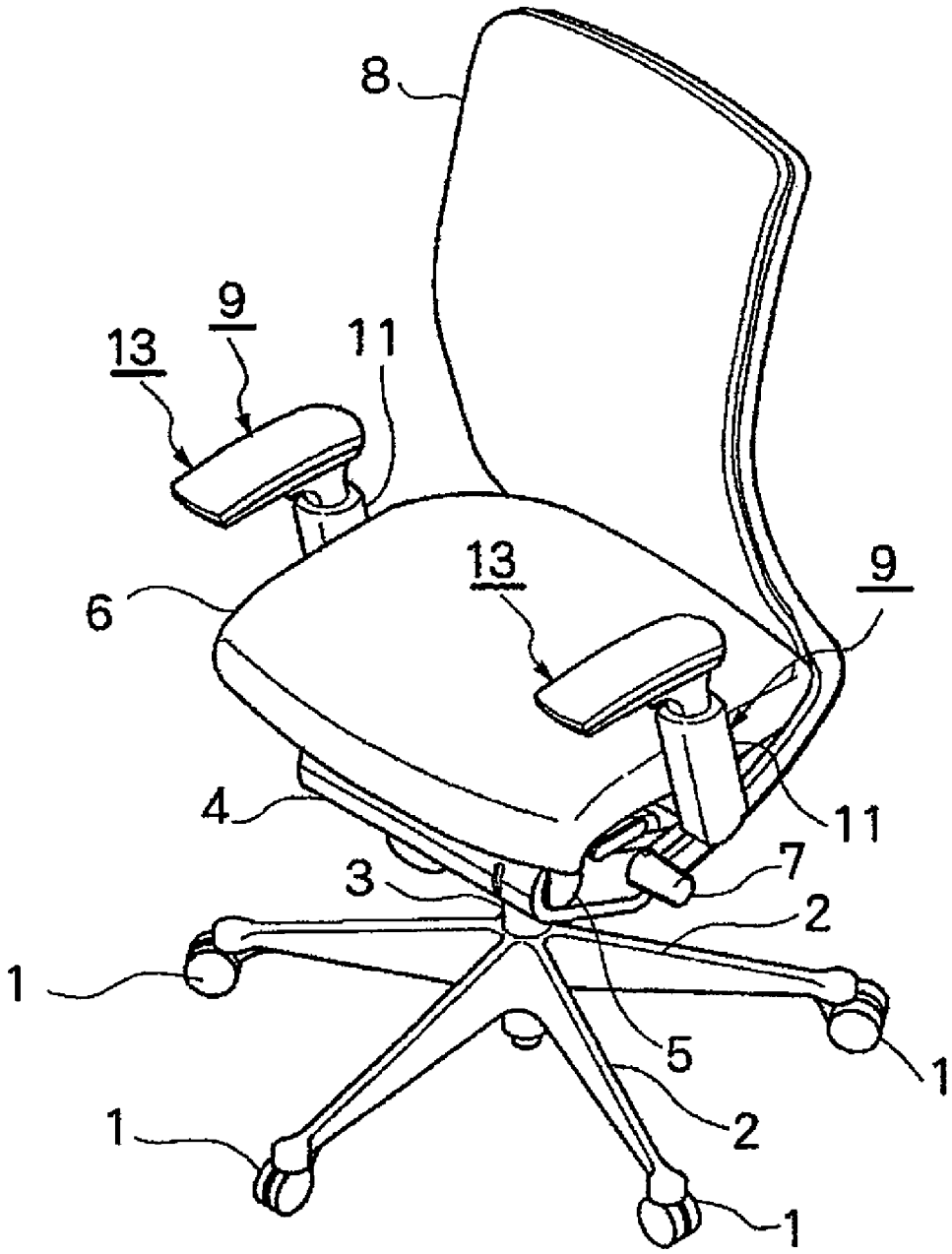
FIG. 1 is a perspective view of a chair comprising an embodiment of an armrest device according to the present invention.
Figure 2:
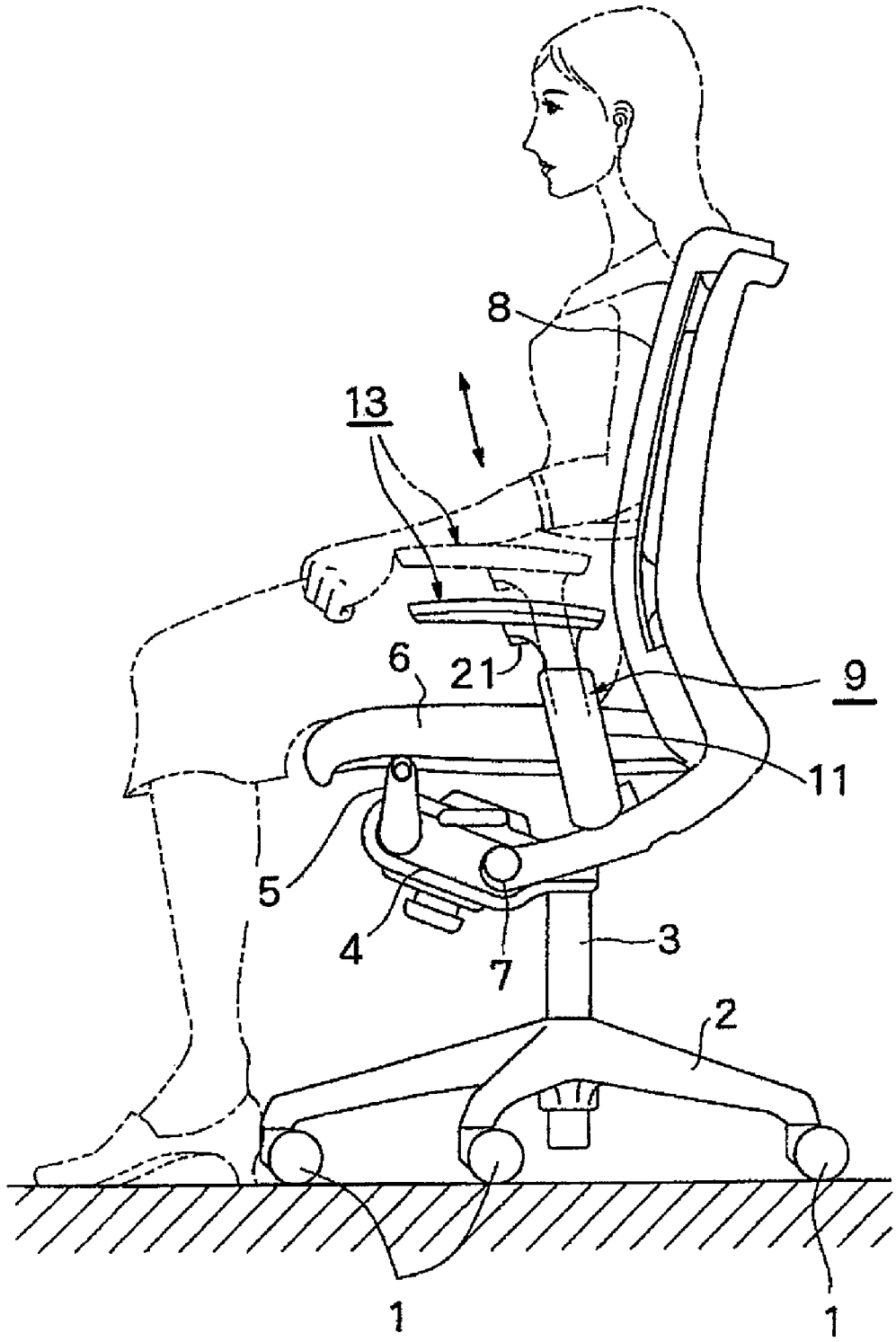
FIG. 2 is a side elevational view thereof.
Figure 3:
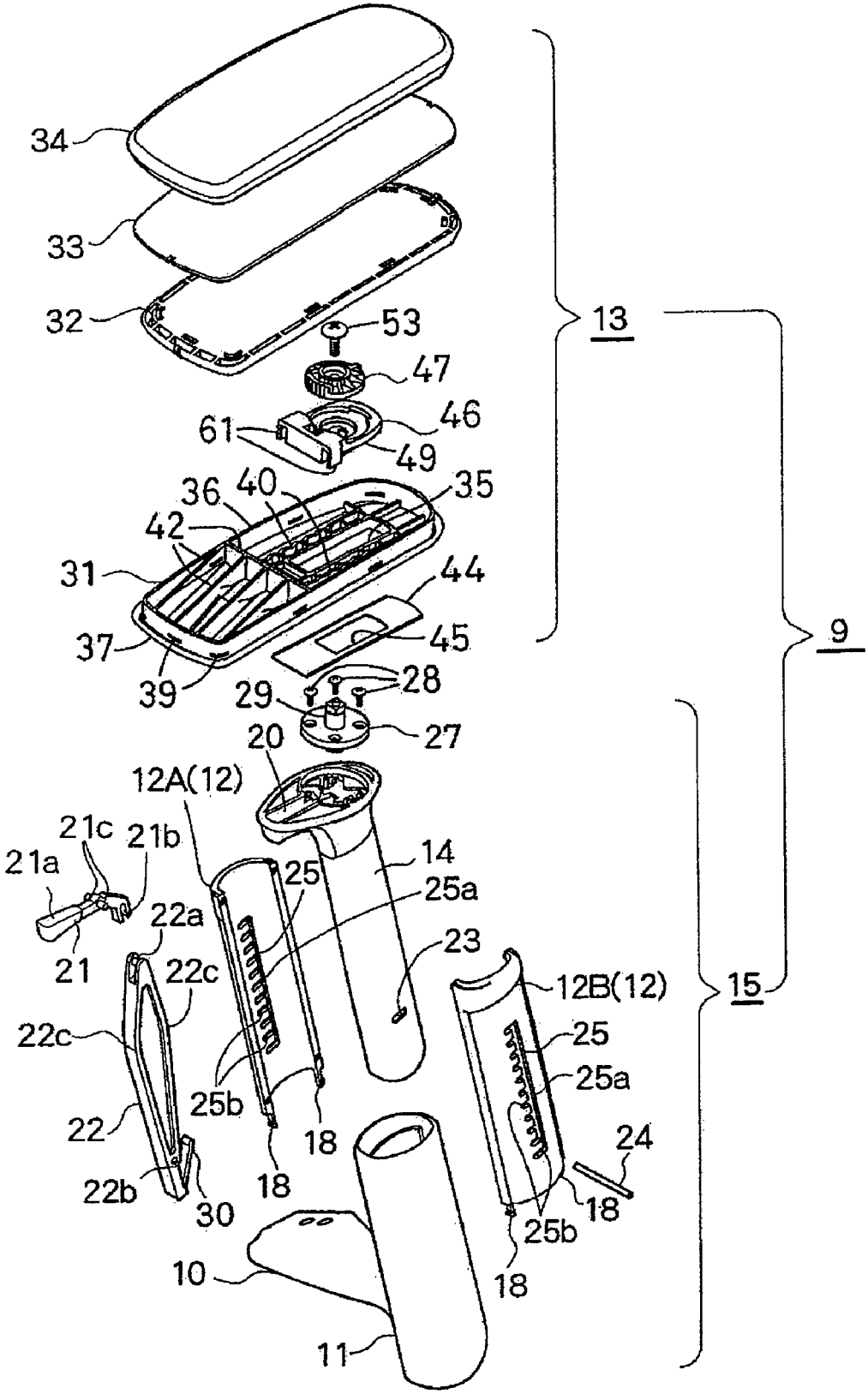
FIG. 3 is an exploded perspective view of the armrest device.
Figure 4:
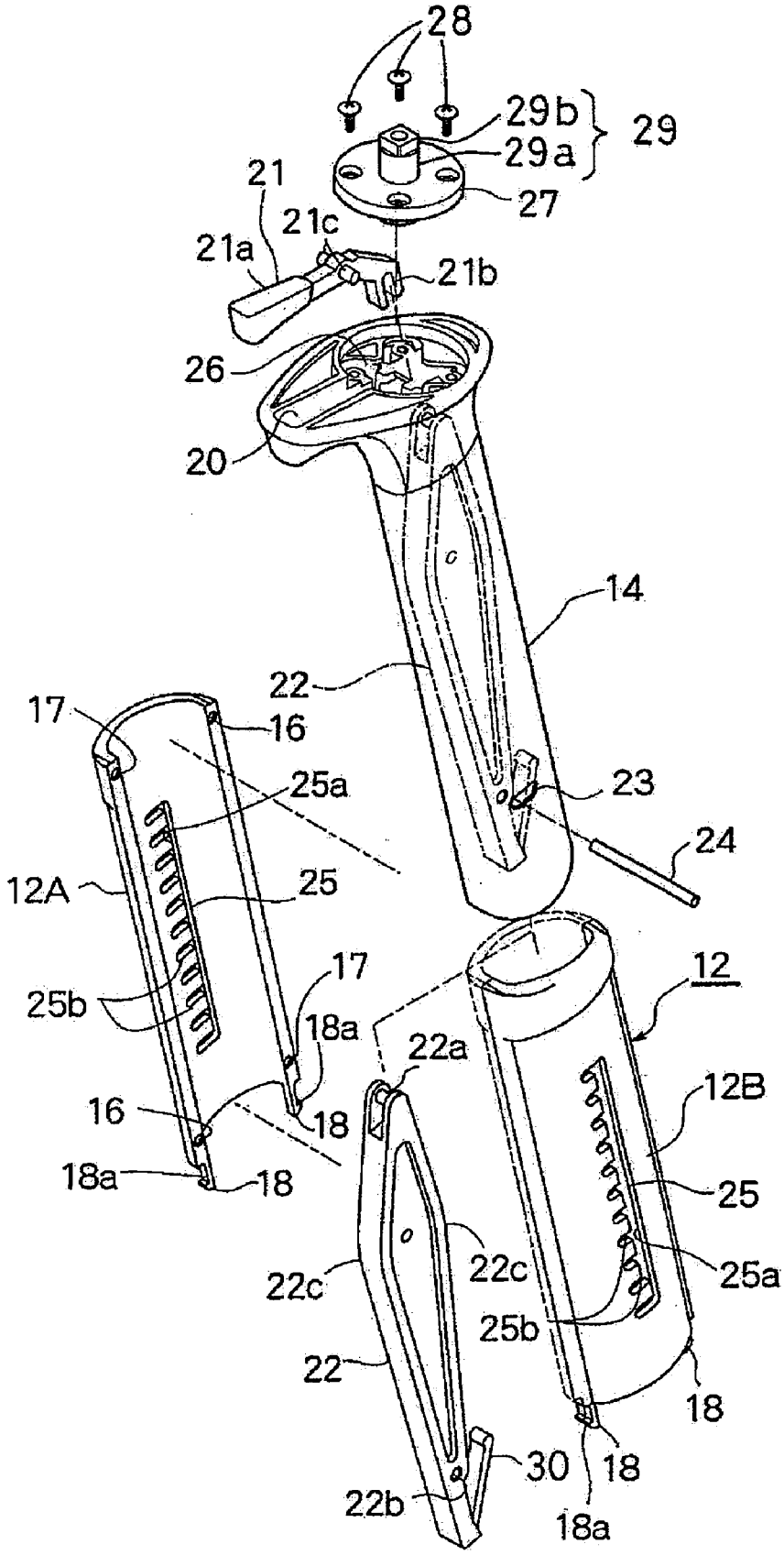
FIG. 4 is an enlarged exploded perspective view of a height adjuster in the armrest device.
Figure 5:
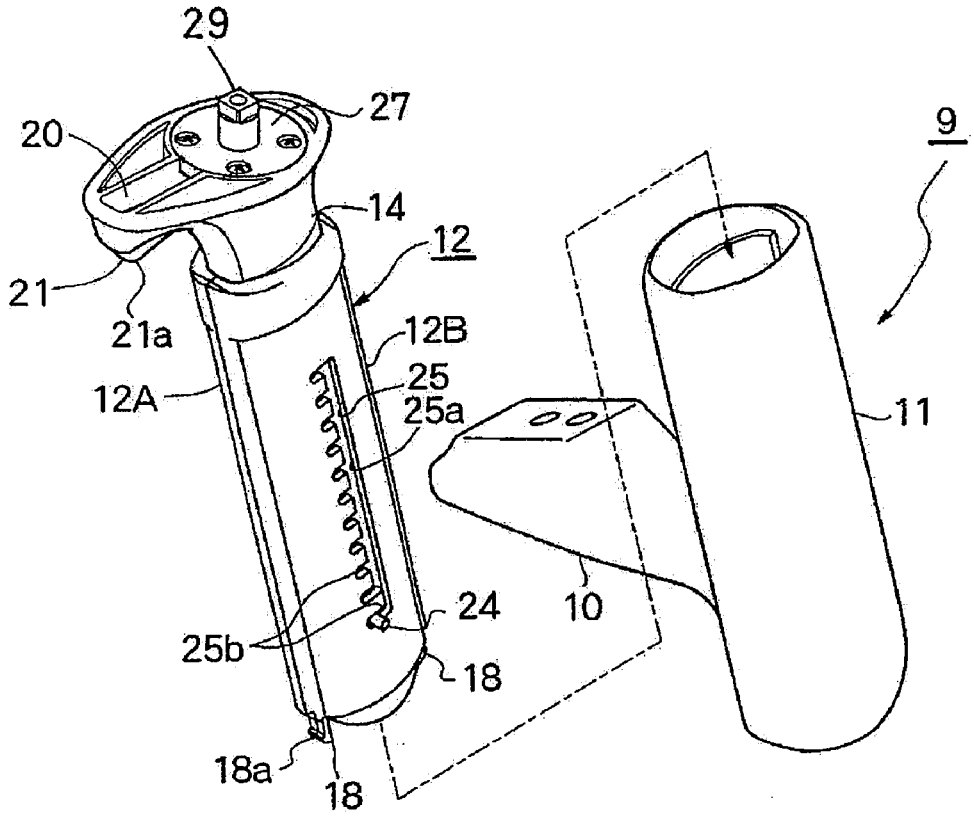
FIG. 5 is an exploded perspective view of the parts which are connected to the height adjuster in FIG. 4.
Figure 6:
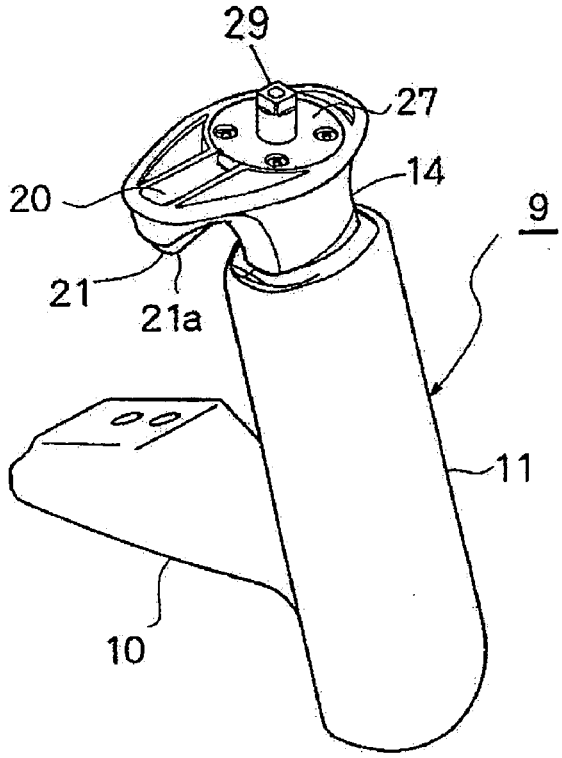
FIG. 6 is a perspective view of the height adjuster completely assembled.
Figure 7:
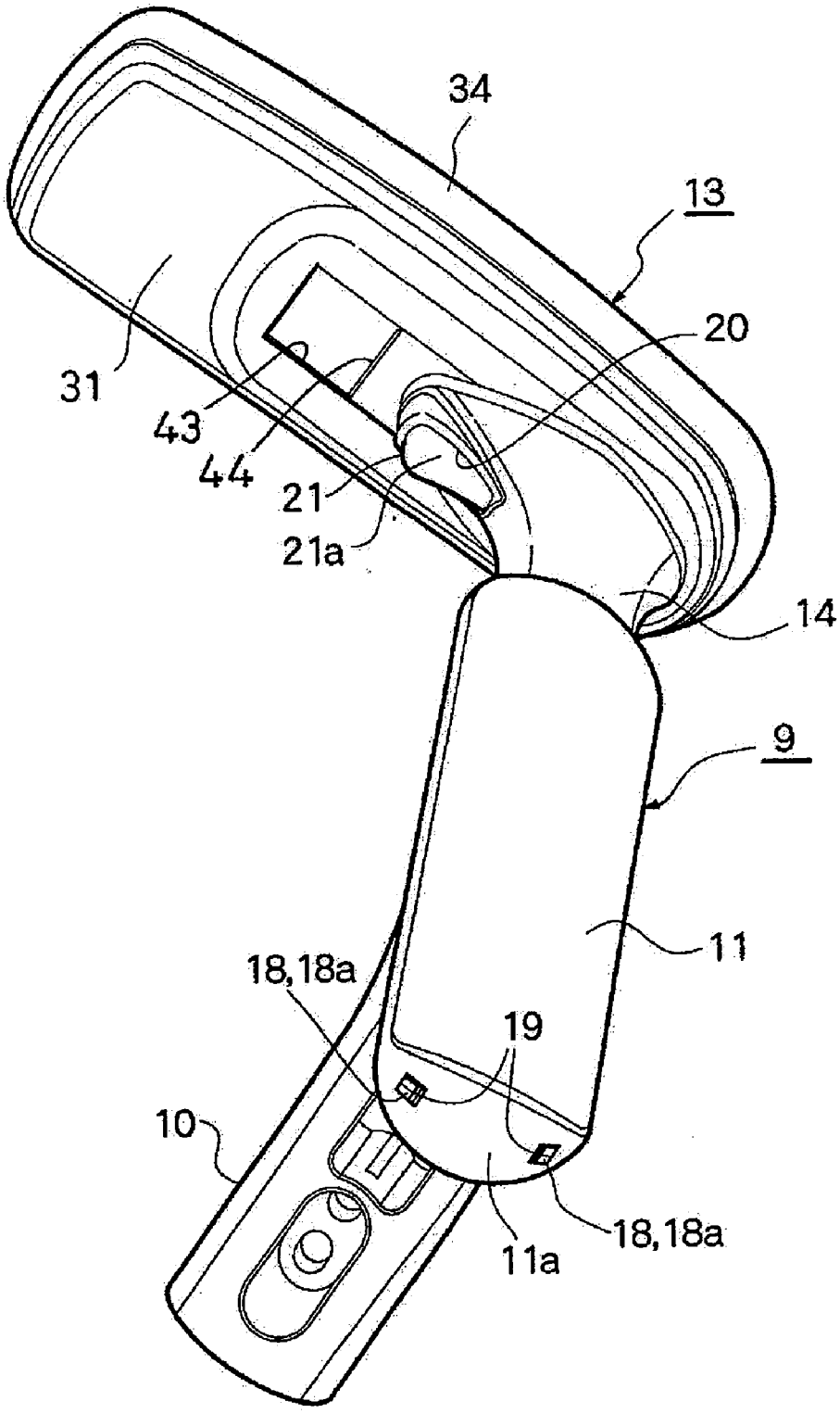
FIG. 7 is a perspective view thereof seen from a position below.

FIG. 1 is a perspective view of an embodiment of a chair comprising an armrest device according to the present invention, and FIG. 2 is a left side view thereof.

The chair comprises a leg 3 that extends upright from five radially-extending feet 2 each of which comprises a caster 1 at the end; a support base 4 at the upper end of the leg 3; a seat 6 supported by a support link 5 over the support base 4; and a backrest 8 pivotally mounted to the support base 4 with a horizontal shaft 7 so that the backrest 8 may be inclined rearward; and an armrest device 9 extending upright from each side of the seat 6. The armrest device 9 may extend upright from one side of the seat 6.

FIGS. 3-8 show the details of the armrest device 9.

The armrest device 9 comprises an armrest-support tube 11 in which a bracket 10 extending from the inside at the lower end is fixed to the lower surface of the seat 6 so that the tube 11 is inclined slightly forward from the side of the seat 6; an intermediate tube 12 which contacts the inner surface of the armrest support tube 11; an armrest support rod 14 which is placed in the intermediate tube 12 to slide up and down; and a height adjuster 15 which adjusts a height of the armrest support rod 14 with respect to the armrest support tube 11.

The armrest support tube 11, the intermediate tube 12 and the armrest support rod 14 have elliptical cross-sections in which the major axis extending forward in the ellipse is slightly longer than the minor axis extending transversely. Other cross-sections may be accepted.

The intermediate tube 12 comprises two semicylindrical pieces 12A, 12B bound to each other. At four corners of the semicylindrical pieces 12A, 12B, a groove 16 and a projection 17 engage with each other when they face each other at a normal position.

At the lower end of the semicylindrical pieces 12A,12B, there is provided an elastic engagement side claw 18 having an outward projection 18*a*. When the semicylindrical pieces 12A,12B are bound, the elastic claws 18,18 engage with engagement holes 19 of a bottom wall 11*a* closing the lower end of the armrest support tube 11 in FIGS. 7 and 8 thereby preventing the intermediate tube 12 from detaching from the armrest support tube 11 while the semicylindrical pieces 12A, 12B are attached to each other.

The height adjuster 15 comprises an operating lever 21 which comprises an operating portion 21*a* projecting forward through a groove 20 in the upper surface of the armrest support rod 14, a reversed U-shaped engagement groove 21*b* at the rear end, and an intermediate portion pivotally mounted on the upper end of the armrest support rod 14 with a shaft 21*c*; a rhombus-shaped turning lever 22 which fits in the armrest support rod 14 to turn around its middle and comprises at the upper end an axial portion 22*a* which engages in the engagement groove 21*b* of the operating lever 21; a pin-fitting hole 22*b* through which a pin 24 passes via an elongate hole 23 in the side wall of the armrest support rod 14 at the lower end; and an elongate portion 25*a*formed in each of the semicylindrical pieces 12A,12B of the intermediate tube 12. The ends of the pin 24 project from the sides of the armrest support rod 14 through the elongate portion 25*a*.

In the operating lever 21, the shaft 21*c* fits in a pair of grooves 26 in the upper end of the armrest support rod 14, and the lower surface of a closing member 27 for closing the upper opening of the armrest support rod 14 contacts the upper surface of the intermediate portion of the operating lever 21, thereby preventing the shaft 21*c* from coming off the groove 26 to allow the shaft 21*c* to be mounted on the armrest support rod 14 easily.

The closing member 27 is formed as a disc and fixed on the upper end of the armrest support rod 14 with a plurality of screws 28 to become part of the armrest support rod 14. An upward shaft 29 having a noncircular axial portion 29*b* like a rectangle at the upper end of a circular axial portion 29*a* projects at the center on the upper surface of the closing member 27.

In the middle of the turning lever 22, lobes 22*c* contact the inner circumferential surface of the armrest support rod 14 and comprise arcs around the same center of curvature at the vertexes of the rhombus to allow the turning lever 22 to turn about the center of curvature of the lobes 22*c* without a pivotal shaft.

The opening 25 of each of the semicylindrical pieces 12A, 12B comprises an elongate portion 25*a* axially of the intermediate tube 12; and a plurality of engagement portions 25*b* extending forward. The ends of the engagement pin 24 projecting sideward from the armrest support rod 14 engage in the elongate portion 25*a* to enable the pin 24 and the armrest support rod 14 to move up and down along the intermediate tube 12 and the armrest support tube 11. When the pin 24 engages in one of the engagement portions 25*b*, the pin 24 and the armrest support rod 14 cannot move.

An elastic tongue 30 extending rearward is integrally formed at the lower end of the turning lever 22. The end of the elastic tongue 30 pressingly contacts the rear inner circumferential surface of the armrest support rod 14 thereby enabling the turning lever 22 to be forced toward an engagement position where the pin 24 engages in any one of the elongate portions 25*b* of the engagement opening 25.

The elastic tongue 30 plays a role of forcing the turning lever to where the pin 24 engages in any one of the engagement portions 25*b*.

Figure 8:
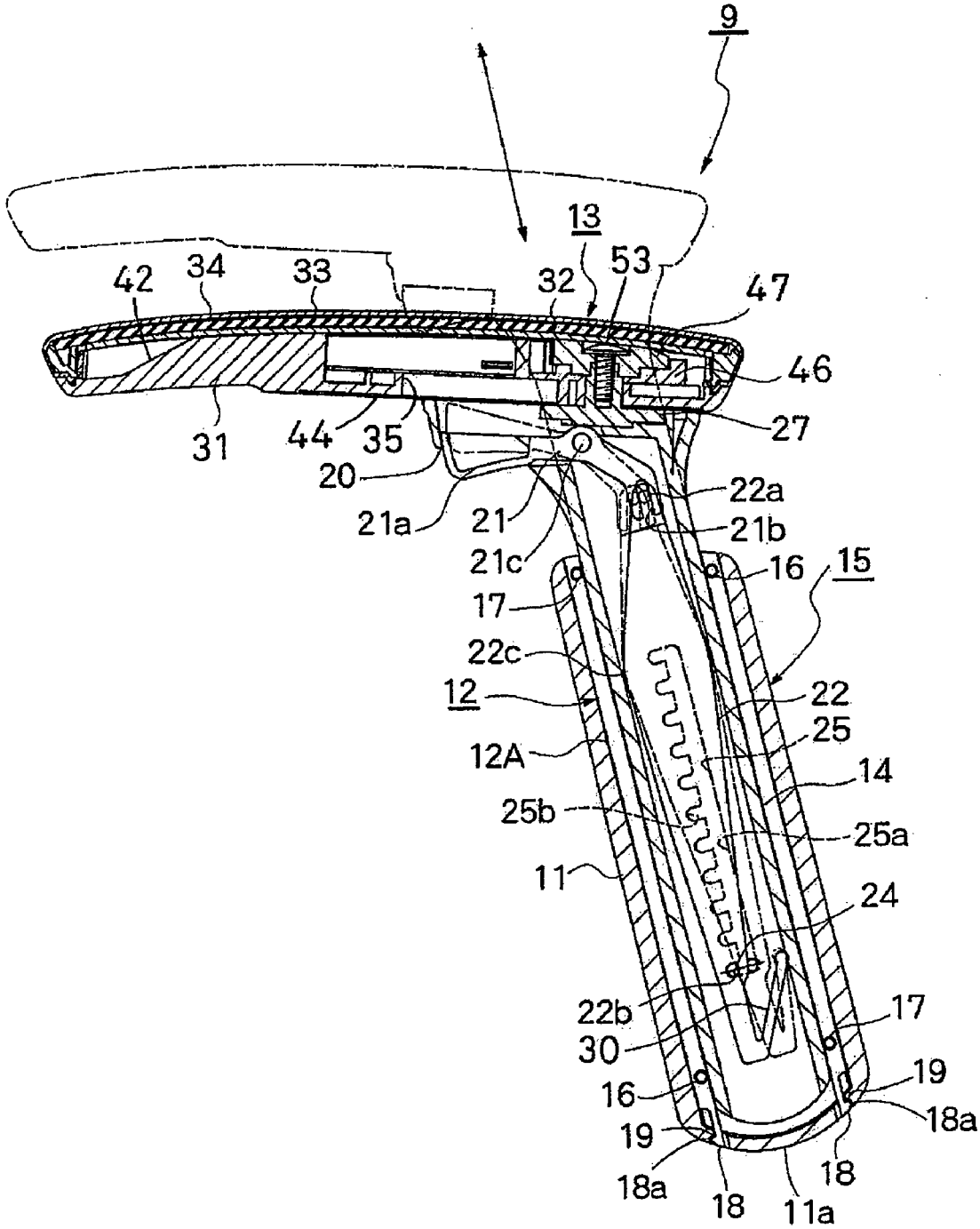
FIG. 8 is a vertical sectional side view thereof.
Figure 9:
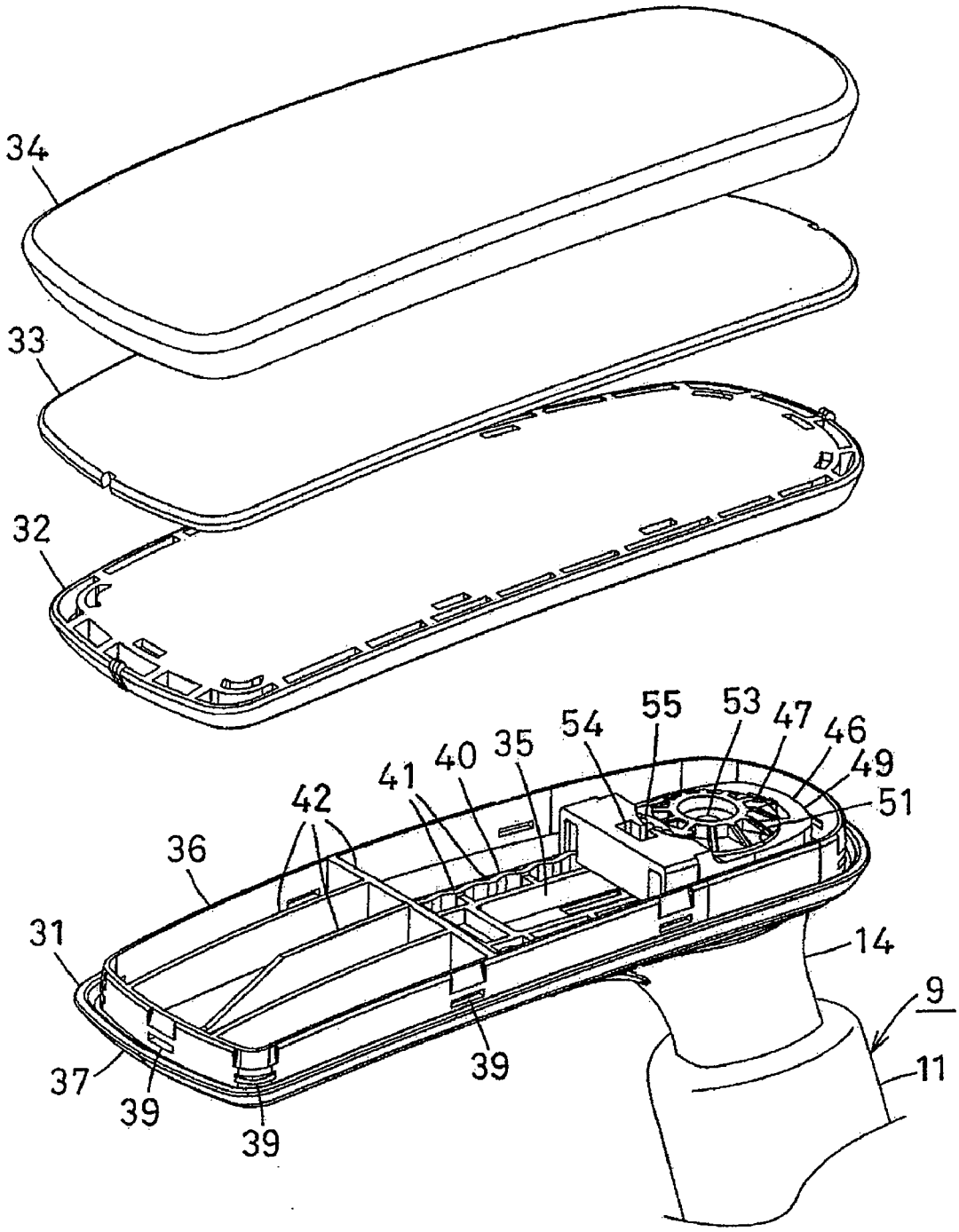
FIG. 9 is an exploded perspective view of an armrest seen from a position above.
Figure 10:
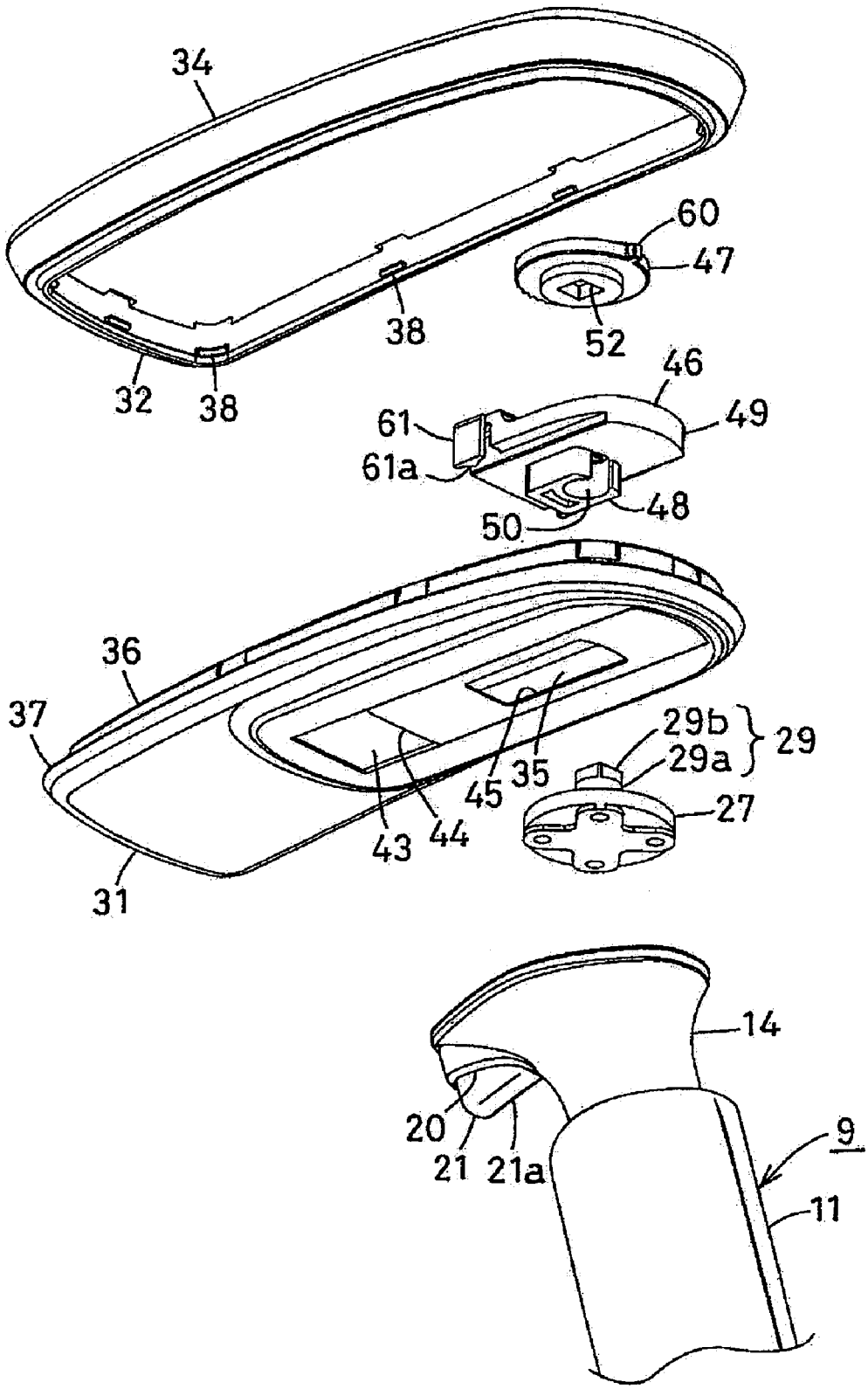
FIG. 10 is an exploded perspective view of the armrest seen from a position below.
Figure 11:
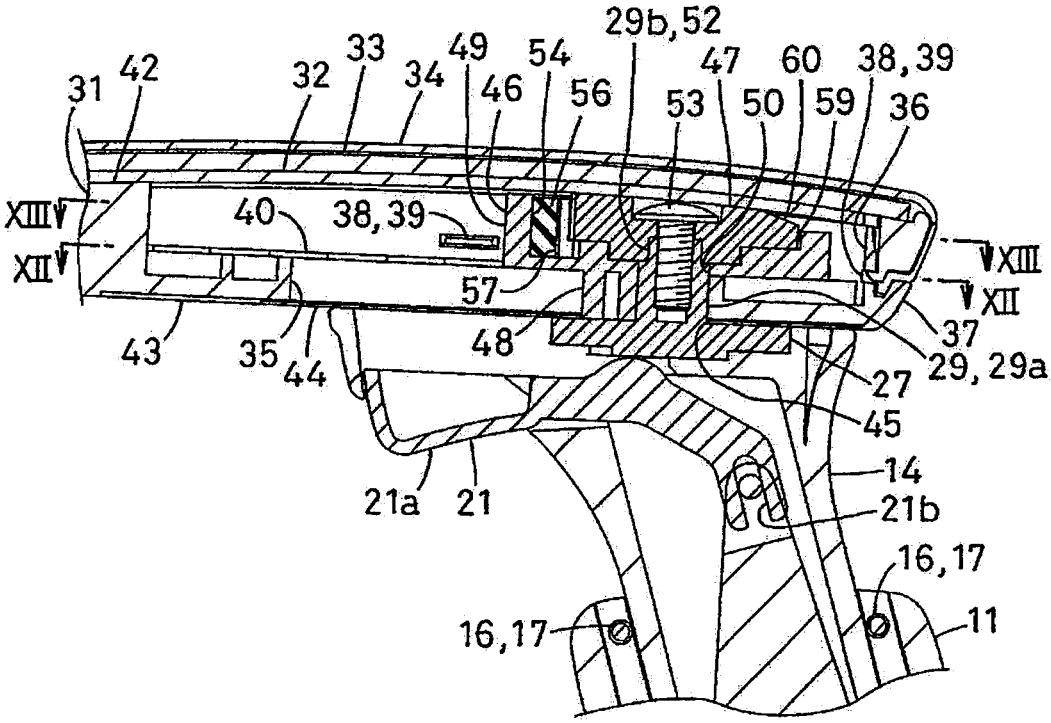
FIG. 11 is an enlarged vertical sectional view of an upper part of the armrest.
Figure 12:
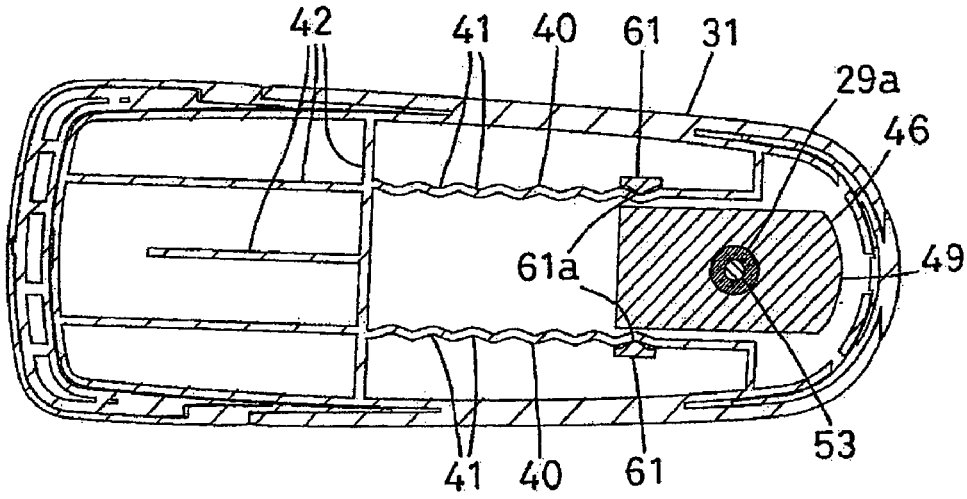
FIG. 12 is a horizontal sectional view taken along the line XII-XII in FIG. 11.
Figure 13:
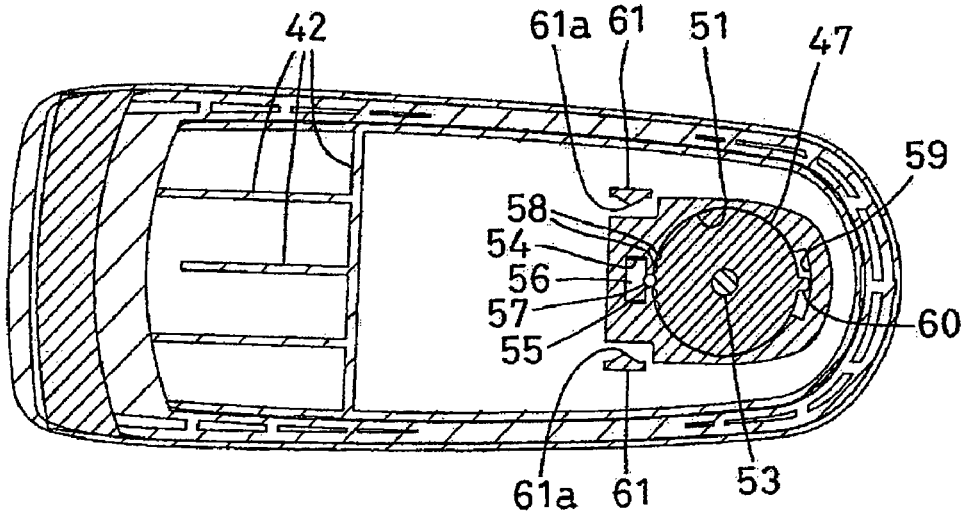
FIG. 13 is a horizontal sectional view taken along the line XIII-XIII in FIG. 11.
Figure 14:
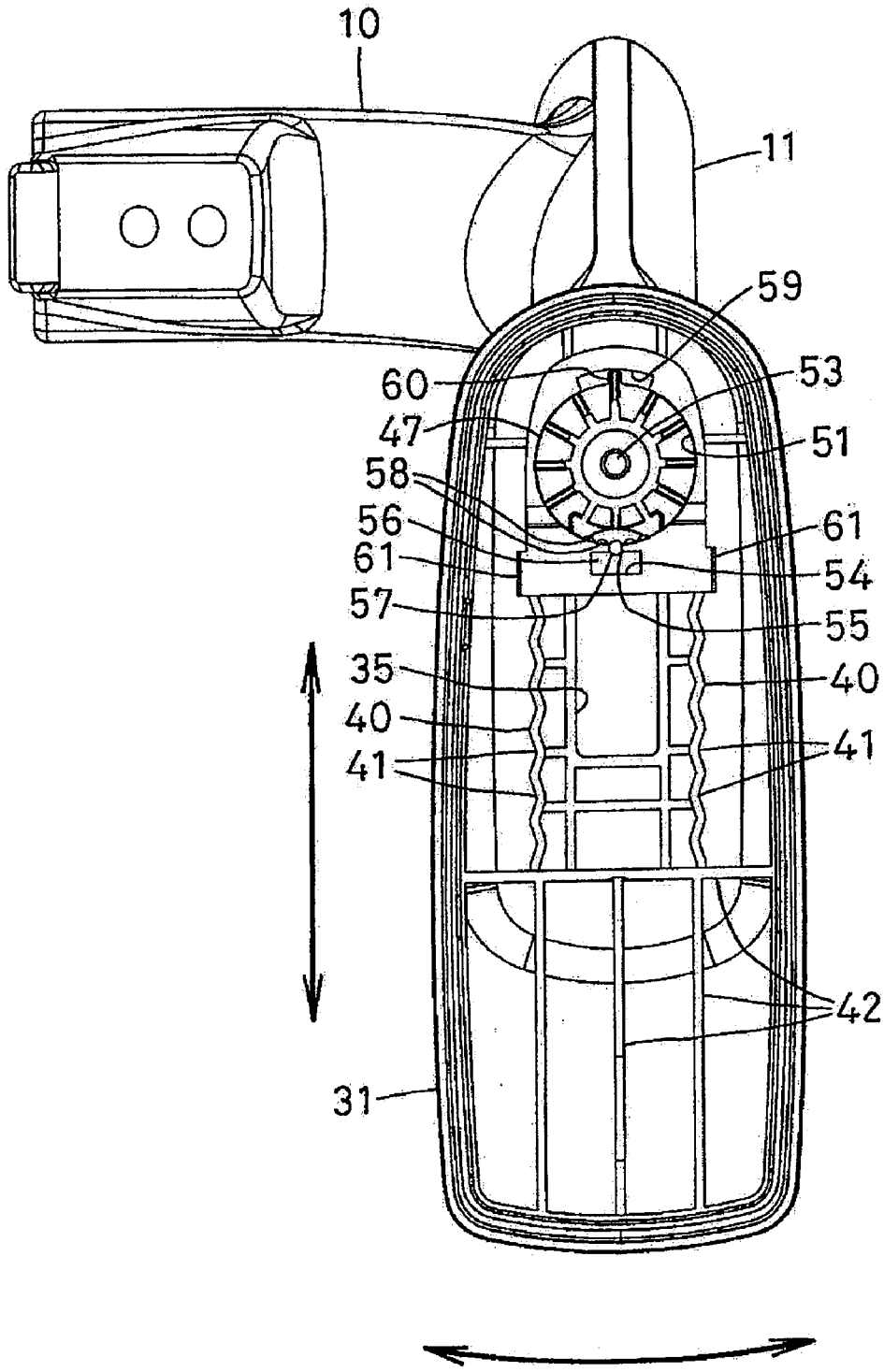
FIG. 14 is a top plan view of the armrest from which a core, cushion material and an armrest pad are removed.
Figure 15:
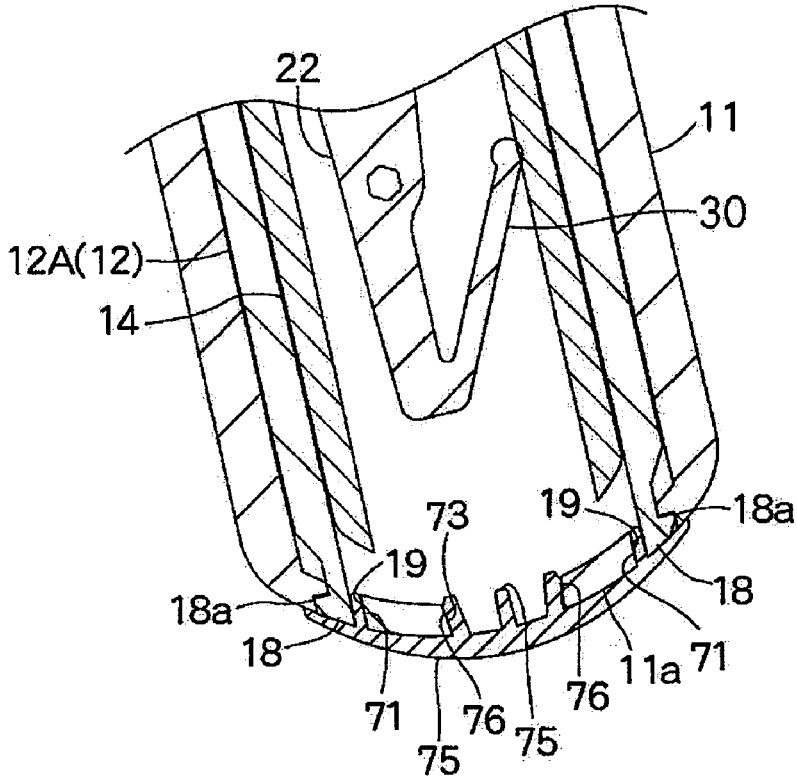
FIG. 15 is a vertical sectional side view of a lower part of the second embodiment of an armrest height adjuster.
Figure 16:
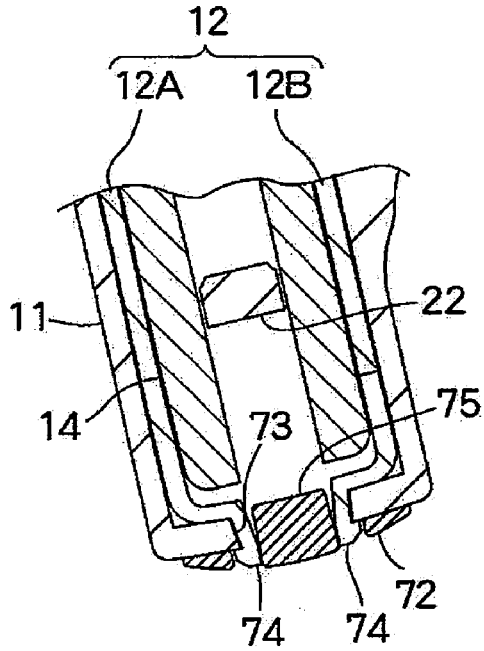
FIG. 16 is a vertical sectional front view thereof.
Figure 17:
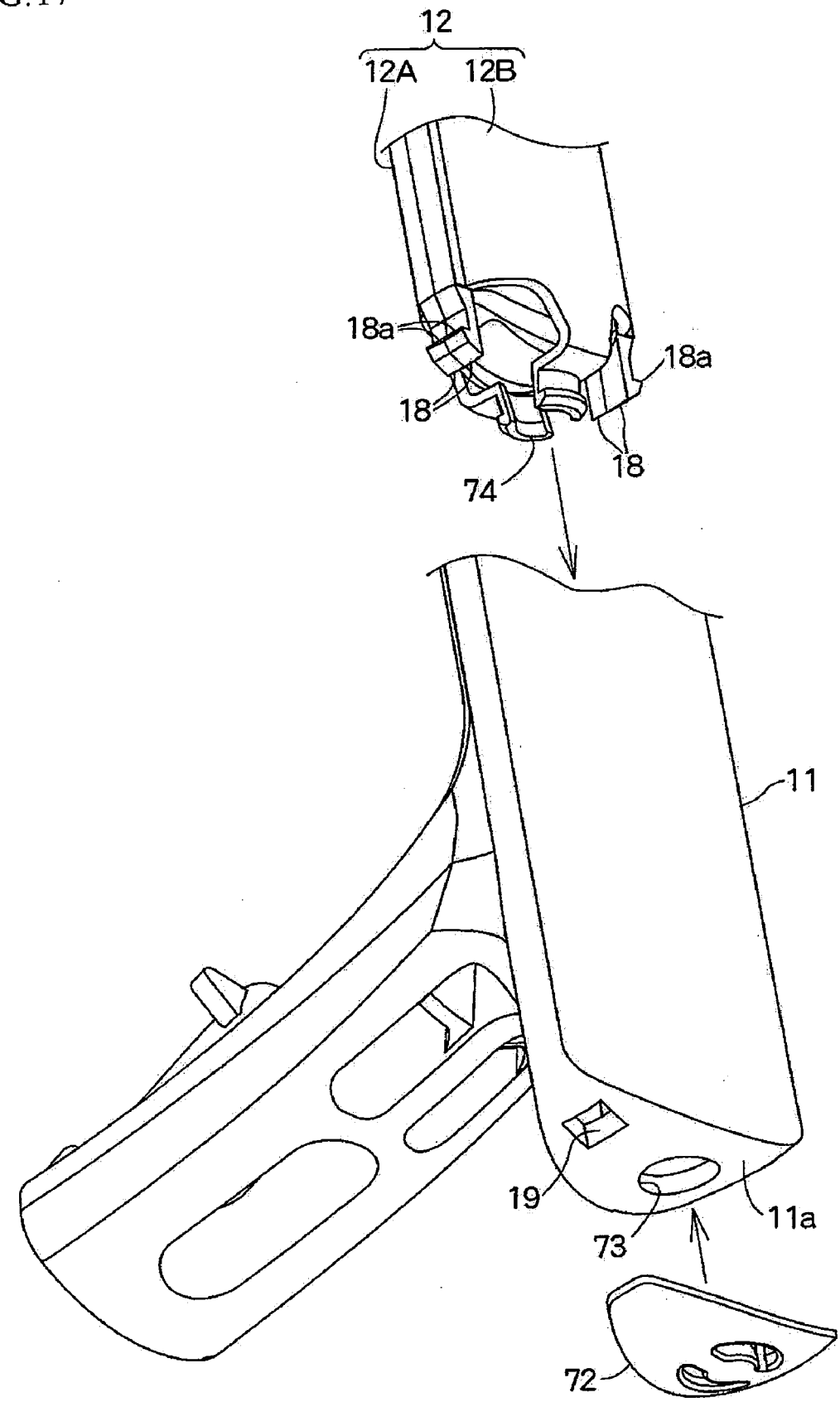
FIG. 17 is an exploded perspective view thereof seen from a position below.
Figure 18:
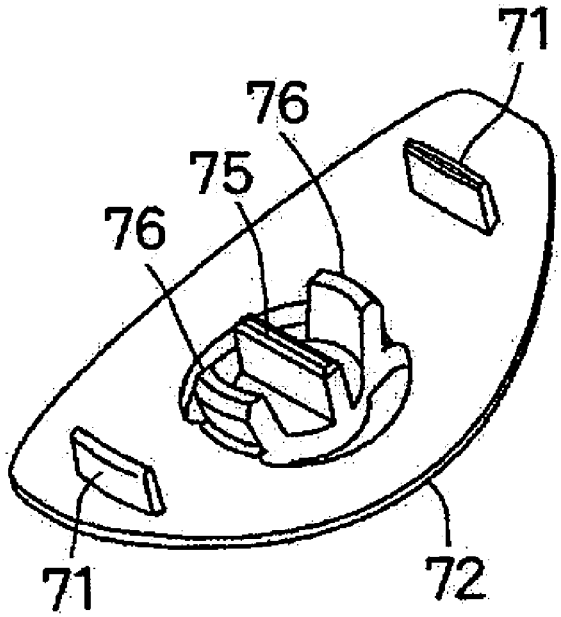
FIG. 18 is a perspective view of a cover.

As shown by a solid line in FIG. 8, the pin 24 engages in any one of the engagement portions 25*b* by the elastic tongue 30, so that the armrest 13 is held at height corresponding to the engagement portion 25*b* and the operating lever 21 is positioned in an inoperative position where the operating portion 21*a* projects forward of the groove 20.

In order to change the height of the armrest 13, the operating portion 21*a* of the operating lever 21 is turned upward against the force of the elastic tongue 30 from the inoperative position as shown by an imaginary line in FIG. 8.

Thus, the rear engagement groove 21*b* of the operating lever 21 is turned forward and the turning lever 22 of which the axial portion 22*a* engages in the groove 21 b is turned anticlockwise as shown by an imaginary line in FIG. 8, so that the pin 24 disengages from the engagement portion 25*b* of the opening 25 and moves into the elongate portion 25*a* in a disengagement position.

Then, while the operating portion 21*a* of the operating lever 21 is kept in the operating position, the armrest 13 and the armrest support rod 14 are elevated or lowered to a desired height. The pin 24 in the elongate portion 25*a* can move up and down along the elongate portion 25*a*.

After the armrest 13 is kept in the desired height, a hand is released from the operating portion 21*a* of the operating lever 21 or an operating force is loosened. The turning lever 22 is urged by the elastic tongue 30 to return to the original engagement position to allow the pin 24 to engage with the nearest engagement portion 25*b*. If the pin 24 does not engage in the engagement portion 25*b* suitably, the armrest 13 may be moved up and down slightly.

The pin 24 engages in any one of the engagement portions 25*b* and the turning lever 22 is returned to the engagement position. Thus, the operating lever 21 is returned to the inoperative position.

To assemble the armrest device 9, after the operating lever 21 is mounted to the armrest support rod 14, the operating lever 21 is positioned and the turning lever 22 is inserted upward from the lower end of the armrest support rod 14 to allow the rear end of the operating lever 21 to engage with the upper end of the turning lever 22 via the engagement groove 21*b* and to allow the elongate hole 23 of the armrest support rod 14 to coincide with the hole 22*b* to facilitate assembling. The center of gravity of the operating lever 21 is positioned closer to the operating portion 21*a* rather than the shaft 21*c* to make the operating portion 21*a* heavier thereby allowing the operating lever 21 to be positioned at the inoperative position. The turning lever 22 pressingly contacts the rear inner circumferential surface of the armrest support rod 14 to allow the turning lever 22 to be positioned at the engagement position thereby omitting special positioning means for the operating lever 21 and turning lever 22.

After the pin 24 is passed through the hole 23 of the armrest support rod 14 and the hole 22*b* of the turning lever 22 which coincide with each other, the semicylindrical pieces 12A and 12B between which the armrest support rod 14 is put face each other while the ends of the pin 24 engages in the engagement portion 25*b*, are bound and inserted into the armrest support tube 11. The elastic claws 18,18 engage in the hole 19 in the bottom wall 11*a* of the armrest support tube 11 thereby assembling the armrest support tube 11, the intermediate tube 12, the armrest support rod 14, the operating lever 21, the turning lever 22 etc. simply and surely.

The structure of the armrest 13 will be described with respect to FIG. 3 and FIGS. 8-14. The armrest 13 comprises a horizontal armrest base plate 31 made of synthetic resin; a core 32 made of soft synthetic resin and covering the upper surface of the base plate 31; cushion material 33 made of foam polyurethane; and a arm pad 34 made of elastomer.

A slot 35 is formed in the middle of the armrest base plate 31 and a peripheral projection 36 and a peripheral edge 37 are provided on the upper surface to hold the core 32 and the armrest pad 34. The outer surface of the peripheral projection 36 has a plurality of slits 39 in which inward claws 38 of the core 32 engage.

At each side of the slot 35 in the upper surface of the armrest base plate 31, a pair of protrusions 40, 40 is provided in parallel with the slot 35. The protrusions 40, 40 have a plurality of recesses 41 like a wave. A plurality of ribs 42 are provided on the upper surface longitudinally and transversely of the armrest base plate 31.

In the lower surface of the armrest base plate 31, a rectangular recess 43 surrounds the slot 35. A shielding plate 44 engages to be capable of sliding back and forth to prevent the slot 35 from being exposed when the armrest base plate 31 goes forward. The shielding plate 44 has a slot 45 in which an engagement portion of a support block 46 engages.

The armrest 13 comprises the support block 46 and a fixed disc 47 to turn about a vertical axis and to move back and forth.

The support block 46 comprises an engagement portion 48 having the same width as that of the slot 35; and a wider portion 49 on the engagement portion 48. A circular axial portion 29*a* of a shaft 29 of the closing member 27 engages in an axial hole 50 in the middle of the support block 46 to allow the support block 46 to turn on the armrest support rod 14.

The fixed disc 47 fits in a circular recess 51 in the upper surface of the wider portion 49 of the support block 46. The non-circular axial portion 29*b* of the shaft 29 fits in the rectangular hole 52 in the middle of the lower surface of the fixed disc 47. The fixed disc 47 is fixed to the upper end of the shaft 29 with a screw 53 to prevent the support block 46 from disengaging from the shaft 29.

The armrest base plate 31 is disposed on the upper end of the armrest support rod 14. The engagement portion 48 of the support block 46 engages in the slot 35 of the armrest base plate 31 and in the slot 45 of the shielding plate 44. The armrest base plate 31 is put between the wider portion 49 of the support block 46 and the upper surface of the armrest support rod 14. Thus, the armrest base plate 31 is mounted to the armrest support rod 14 to slide back and forth and to turn with the support block 46 about the shaft 29.

In front of the recess 51 in the upper surface of the support block 46, there are formed a rectangular hole 54 and a narrower communicating hole 55 which allows the rear middle of the rectangular hole 54 to communicate with the recess 51. Force of an elastic member 56 such as rubber fitting in the rectangular hole 54 allows a vertical pin 57 in the communicating hole 55 to be pressed onto the outer circumferential surface of the fixed disc 47 thereby allowing the pin 57 to engage elastically on a plurality of recesses 58 on the outer circumferential surface of the fixed disc 47, so that suitable stepwise resistant force is given to rotation of the support block 46.

At the back of the recess 51 in the upper surface of the support block 46, a fan-shaped recess 59 having the same center as that of the axial hole 50 is formed to engage with a projection 60 on the outer circumferential surface of the fixed disc 47 thereby limiting a turning range of the support block.

On the upper part of the sides of the wider portion 49 of the support block 46, elastic downward tongues 61, 61 are fixed. A projection 61*a* of each of the elastic tongues 61 is pressed onto the recess 41 of the projection 40 of the armrest base plate 31 thereby applying stepwise resistant force when the projection 61*a* engages in the recess 41 elastically.

In the embodiment, there are back-and-forth movement guiding means for the armrest base plate 31 comprising the slot 35 of the armrest base plate 31 and the engagement portion 48 of the support block 46; and relaxation-giving means comprising the recesses 41 in the projections 40 and the elastic tongues 61 at the side of the wider portion 49 of the support block 46. Both the means are separated from each other to allow the armrest base plate 31 to move back and forth stably and smoothly. Furthermore, the projections 40 and the elastic tongues 61 are integrally formed with the armrest base plate 31 and the support block 46 respectively thereby saving the number of parts and facilitating assembly.

The projections 40 and the elastic tongues 61 are symmetrically provided as a pair to surround the slot 35 of the armrest base plate 31 to enable the armrest base plate 31 to move back and forth stably and smoothly.

The support block 46 can be turned about an axis extending perpendicular to the upper surface of the armrest support rod 14 to allow the armrest base plate 31 to slide back and forth with respect to the armrest support rod 14 and to turn transversely, so that the armrest base plate 31 can be moved back and forth smoothly and turned stably and smoothly in a transverse direction.

Between the upper surface of the armrest support rod 14 and the lower surface of the armrest base plate 31, the shielding plate 44 prevents the slot 35 of the armrest base plate 31 from exposing downward when the armrest base plate 31 is moved forward, thereby preventing a finger from being held by the slot 35 and providing good appearance.

The present invention is not limited to the embodiment above. Various changes and modifications may be made without departing from the scope of claims.

For example, a plurality of recesses are arranged in the inner side surface of a projection to allow the end of a elastic tongue to press onto the inner side surface.

FIGS. 15-18 show a variation of a height-adjuster of an armrest.

A projection 71 fits in a hole 19 in a bottom wall 11*a* of an armrest support tube 11 to prevent an elastic engagement side claw 18 from coming off the hole 19 and to prevent an intermediate tube 12 from coming off the armrest support tube 11.

The projections 71 are provided on the upper surface of a cover 72 covering the lower surface of the bottom wall 11*a* of the armrest support tube 11 to allow the projection 71 to engage in the hole 19 easily. The bottom wall 11*a*, especially the hole 19 of the armrest support tube 11, is covered with the cover 72 providing good appearance.

A circular hole 73 is formed in the middle of the bottom wall 11*a* of the armrest support tube 11. A pair of arcuate elastic engagement claws 74,74 is provided at the lower end of the semicylindrical pieces 12A,12B of the intermediate tube 12 to engage on the edge of the circular hole 73. The cover 72 has in the middle a middle projection 75 which engages between elastic engagement middle claws 74 and 74 in the circular hole 73 to prevent the middle claws 74 from elastically flexing inwards, and elastic projections 76,76 which engage with the edge of the hole 73.

By such structure, the intermediate tube 12 is prevented from coming off the armrest support tube 11.

What is claimed is:

1. An armrest device in a chair, comprising:

an armrest support tube extending upright from a seat;

a tubular armrest support rod that slides up and down in the armrest support tube to support an armrest;

an intermediate tube surrounding the armrest support rod in the armrest support tube and having a plurality of engagement portions;

an operating lever having a middle portion which is pivotally mounted to an upper end of the armrest support rod, the operating lever comprising an operating portion that projects forwards of the armrest support rod; and a turning lever that fits in said armrest support rod and has lobes in a middle contacting an inner circumferential surface of the armrest support rod and a hole at a lower end, the turning lever pivoting about a center of curvature of the lobes, one of a rear end of said operating lever and an upper end of the turning lever having an engagement groove which engages with the other, a pin through the hole at the lower end of the turning lever passing through a hole of the armrest support rod, the pin selectively engaging in any one of the plurality of engagement portions, the turning lever comprising an urging portion urging the pin to engage with any one of the engagement portions, wherein a shaft is transversely projected in a middle of the operating lever and engages in a groove which opens upwards at an upper end of the armrest support rod, a lower surface of a closing member that closes an upper opening of the armrest support rod contacting the upper surface of the middle portion of the operating lever so that said shaft is prevented from coming off the groove.

2. An armrest device of claim 1 wherein the urging portion comprises an elastic tongue provided on the turning lever to pressingly contact the inner circumferential surface of the armrest support rod.

3. An armrest-height adjuster in an armrest, comprising:

an armrest support tube extending upright from a seat and having a bottom wall closing a lower end of the armrest support tube, the bottom wall having at least one engagement hole;

an armrest support rod supporting an armrest and fitting in the armrest support tube to be capable of sliding up and down;

a pin projecting from sides of the armrest support rod;

an intermediate tube surrounding the armrest support rod in the armrest support tube and having an opening comprising a vertically elongate portion and a plurality of engagement portions extending horizontally from the elongate portion;

an operating lever of the armrest support rod to enable the pin to move up and down along the elongate portion to engage selectively in any one of said plurality of engagement portions; and at least one elastic engagement claw projecting downward at a lower end of the intermediate tube to engage in the engagement hole of the armrest support tube to prevent the intermediate tube from disengaging from the armrest support tube.

4. An armrest-height adjuster of claim 3 wherein a pair of elastic engagement claws are provided at sides and at the lower end of the intermediate tube.

5. An armrest-height adjuster in an armrest, comprising:

an armrest support tube extending upright from a seat and having a bottom wall, the bottom wall having at least one engagement hole;

an armrest support rod supporting an armrest and fitting in the armrest support tube to be capable of sliding up and down;

a pin projecting from sides of the armrest support rod;

an intermediate tube surrounding the armrest support rod in the armrest support tube and having an opening comprising a vertically elongate portion and a plurality of engagement portions extending horizontally from the elongate portion;

an operating lever of the armrest support rod to enable the pin to move up and down along the elongate portion to engage selectively in any one of said plurality of engagement portions; and at least one elastic engagement claw projecting downward at a lower end of the intermediate tube to engage in the engagement hole of the armrest support tube to prevent the intermediate tube from disengaging from the armrest support tube, and further comprising a cover covering a lower surface of the bottom wall of the armrest support tube, a projection on an upper surface of the cover preventing the elastic engagement claw from disengaging from the engagement hole.

6. An armrest-height adjuster in an armrest, comprising:

an armrest support tube extending upright from a seat and having a bottom wall, the bottom wall having at least one engagement hole;

an armrest support rod supporting an armrest and fitting in the armrest support tube to be capable of sliding up and down;

a pin projecting from sides of the armrest support rod;

an intermediate tube surrounding the armrest support rod in the armrest support tube and having an opening comprising a vertically elongate portion and a plurality of engagement portions extending horizontally from the elongate portion;

an operating lever of the armrest support rod to enable the pin to move up and down along the elongate portion to engage selectively in any one of said plurality of engagement portions; and at least one elastic engagement claw projecting downward at a lower end of the intermediate tube to engage in the engagement hole of the armrest support tube to prevent the intermediate tube from disengaging from the armrest support tube, wherein the intermediate tube comprises two semicylindrical pieces each of which has two elastic engagement claws, two adjacent elastic engagement claws of the two semicylindrical pieces passing through the same engagement hole of two engagement holes.

7. An armrest-height adjuster in an armrest, comprising:

an armrest support tube extending upright from a seat and having a bottom wall, the bottom wall having at least one engagement hole;

an armrest support rod supporting an armrest and fitting in the armrest support tube to be capable of sliding up and down;

a pin projecting from sides of the armrest support rod;

an intermediate tube surrounding the armrest support rod in the armrest support tube and having an opening comprising a vertically elongate portion and a plurality of engagement portions extending horizontally from the elongate portion;

an operating lever of the armrest support rod to enable the pin to move up and down along the elongate portion to engage selectively in any one of said plurality of engagement portions; and at least one elastic engagement claw projecting downward at a lower end of the intermediate tube to engage in the engagement hole of the armrest support tube to prevent the intermediate tube from disengaging from the armrest support tube;

further comprising a turning lever pivotally mounted to the operating lever and having lobes in a middle, said lobes contacting an inner circumferential surface of the armrest support rod, said turning lever having a pin-inserting hole at a lower end and pivoting about a center of curvature of the lobes, the pin passing through the pin-inserting hole of the turning lever, ends of the pin projecting from the pin-inserting hole to selectively engage in any one of the engagement portions of the intermediate tube.

8. An armrest-height adjuster of claim 7, further comprising an elastic tongue on the turning lever to allow an end of the turning lever to pressingly contact the inner circumferential surface of the armrest support rod.

* * * * *